US006644421B1

(12) United States Patent
Long

(10) Patent No.: US 6,644,421 B1
(45) Date of Patent: Nov. 11, 2003

(54) SONDE HOUSING

(75) Inventor: David Long, Puyallup, WA (US)

(73) Assignee: Robbins Tools, Inc., Solon, OH (US)

( * ) Notice: Subject to any disclaimer, the term of this patent is extended or adjusted under 35 U.S.C. 154(b) by 23 days.

(21) Appl. No.: 10/035,931

(22) Filed: Dec. 26, 2001

(51) Int. Cl.[7] ..... E21B 47/00
(52) U.S. Cl. ..... 175/40; 175/320
(58) Field of Search ..... 175/40, 73, 320

(56) References Cited

U.S. PATENT DOCUMENTS

| | | | | |
|---|---|---|---|---|
| 2,857,451 A | | 11/1958 | Barclay | |
| 3,149,490 A | * | 9/1964 | Clements et al. | 73/152.46 |
| 3,461,979 A | | 8/1969 | Newfarmer | |
| 3,653,050 A | | 3/1972 | Eggleston, Jr. | |
| 4,461,997 A | | 7/1984 | Ohmer | |
| 4,511,843 A | | 4/1985 | Thoraval | |
| 4,652,861 A | | 3/1987 | Domes | |
| 4,735,264 A | * | 4/1988 | Burris, II et al. | 166/242.1 |
| 4,912,415 A | | 3/1990 | Sorensen | |
| 5,253,721 A | * | 10/1993 | Lee | 175/73 |
| 5,337,002 A | | 8/1994 | Mercer | |
| 5,530,357 A | | 6/1996 | Cosman et al. | |
| 5,563,512 A | | 10/1996 | Mumby | |
| 5,682,099 A | | 10/1997 | Thompson et al. | |
| 5,934,391 A | | 8/1999 | Cox | |
| 6,084,052 A | | 7/2000 | Aufdermarsh et al. | |
| 6,131,658 A | | 10/2000 | Minear | |
| 6,148,935 A | * | 11/2000 | Wentworth et al. | 175/398 |
| 6,405,795 B2 | * | 6/2002 | Holbert et al. | 166/66 |
| 6,422,782 B1 | * | 7/2002 | Wentworth | 403/353 |
| 6,470,979 B1 | * | 10/2002 | Wentworth et al. | 175/320 |

OTHER PUBLICATIONS

Geological Boring, L.L.C., Sonde Housings, Date: at least prior to Dec. 26, 2001, 1 sheet.
Inrock Drilling Systems, believed to be printout from a website, Date: at least prior to Dec. 26, 2001, 1 sheet.

* cited by examiner

*Primary Examiner*—Hoang Dang
(74) *Attorney, Agent, or Firm*—Pearne & Gordon LLP

(57) ABSTRACT

A sonde housing construction that is cost effective to manufacture, has a prolonged service life and has an internal cartridge that has replaceable parts and that can be entirely replaced. The cartridge which in service contains and protects a radio transmitter also serves to protect a main shell body from abrasion by drilling/cooling fluid while sealing radio wave apertures formed in the shell body. The cartridge creates an annular flow path for drilling/cooling fluid that ensures complete cooling protection of the transmitter.

12 Claims, 2 Drawing Sheets

SONDE HOUSING

BACKGROUND OF THE INVENTION

The invention relates to improvements in sonde housings used in horizontal direction drilling to carry a radio transmitter that indicates the location and orientation of a drill head.

Horizontal direction drilling in geological formations is widely used to place product such as pipe, conduit or cable underground. Typically, the location and orientation of the drill head is monitored as it progresses through the earth so that corrections can be made to keep the actual path as close as possible to the desired path. The location and orientation of the drill head is signaled to the surface by a radio transmitter carried in a so-called sonde housing that is interposed in the drill string just behind the drill head. The sonde housing includes passages for fluid that is used in the drilling process and that advantageously cools the sonde housing so that heat from the drilling operation does not overheat the electronics of the transmitter.

Conventional prior art sonde housings have been fabricated by machining steel bars or tubes to provide a chamber for the transmitter and axial passages for the fluid. That fluid creates a jet at the drill face or provides hydraulic power for a directional drill motor and, as mentioned, cools the transmitter. Typically, the prior art sonde housings are relatively expensive because of the special machining operations that are performed to create the chamber and various passages through the full length of the housing. This cost is significant to a drilling company because the typical sonde housing has a limited life. The fluid that passes through the sonde housing is continuously recycled. Although it is filtered, fine sand particles remain in the fluid causing it to be highly abrasive. The fluid, because of its abrasiveness, wears away at the passages in the housing eventually destroying it. Another problem frequently encountered with known types of sonde housings is related to slots or other apertures formed in the housing wall that allow transmission of radio waves out of the metal housing. The slots are frequently filled with epoxy or other non-metallic material to exclude fluid from the chamber in which the transmitter is received. This material is prone to leak internally after a period of use with the result that the transmitter and its associated battery can become cemented in the chamber by fluid borne solids making it very difficult to remove the transmitter without harm.

SUMMARY OF THE INVENTION

The invention provides an improved sonde housing that can be economically manufactured and that has improved performance both in resistance to wear and resistance to internal leakage. Various internal parts, while being made of relatively inexpensive materials, are capable of an extended service life meeting or exceeding that of more expensive traditional materials. Still further, internal parts that are susceptible to wear by abrasion from the fluid being conducted through the housing are replaceable at relatively low cost. As disclosed, the sonde housing comprises an outer metal cylindrical shell or main body having tool joints at each end. The shell wall is slotted at circumferentially spaced locations for transmission of radio signals from the transmitter carried within the shell body. A cartridge assembly is positioned in the shell body to provide a sealed chamber for the transmitter, an annulus for conducting fluid through the housing and a sleeve to seal the radio transmission slots in the shell wall and to protect the shell wall from abrasion from the circulating fluid. The main parts of the cartridge are formed of a suitable plastic so that they are extremely cost effective and, advantageously, are inherently transparent to the radio wave signals generated by the transmitter.

In the disclosed arrangement of the housing, the sleeve of the cartridge not only protects the shell body from abrasion, but also by sealing the radio signal emitting apertures in the shell wall, avoids the seal failure problems normally encountered in the prior art where the apertures are sealed with epoxy.

DESCRIPTION OF THE PREFERRED EMBODIMENT

Figure 1A:
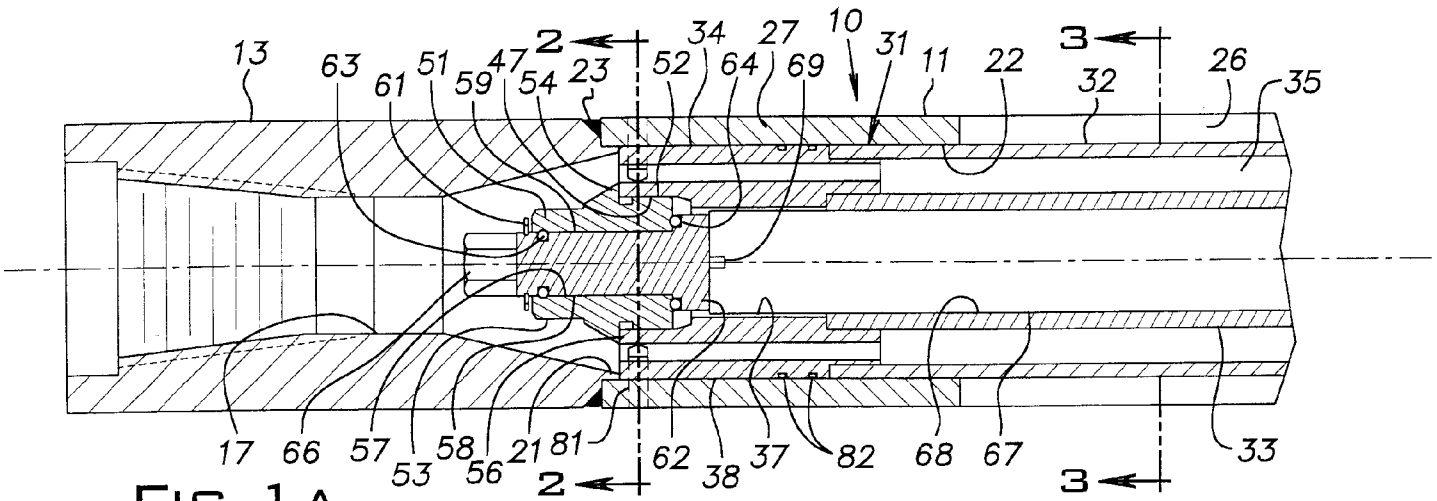
FIGS. 1A and 1B are left and right-hand portions of a sonde housing, constructed in accordance with the invention taken in a longitudinal cross-sectional view.
Figure 1B:
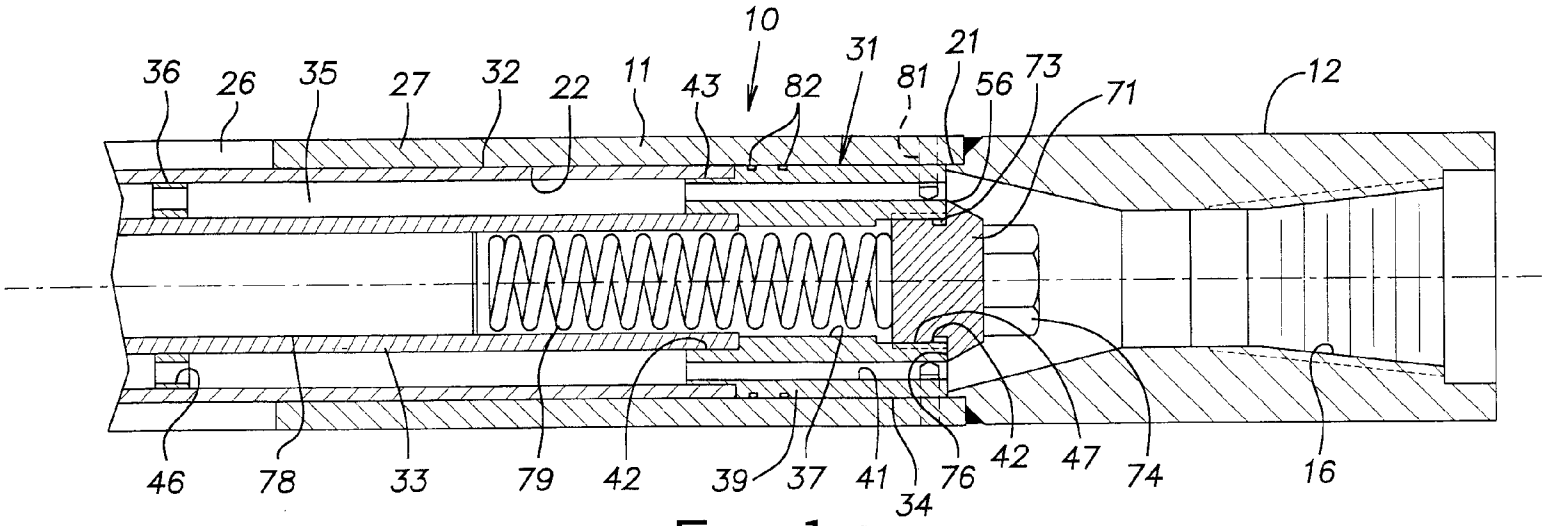
Figure 3:
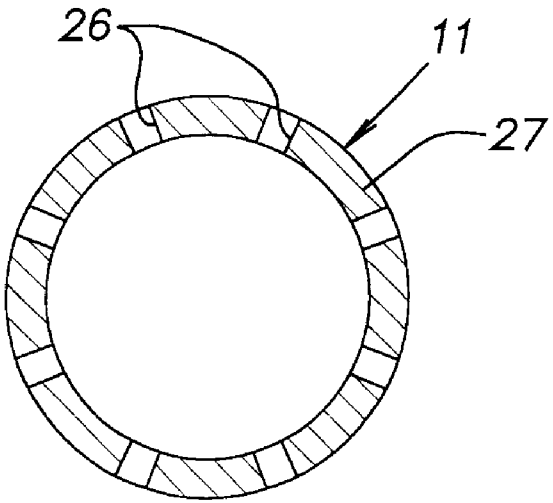
FIG. 3 is a transverse cross-sectional view of a main shell body of the housing taken in the plane indicated at 3—3 in FIG. 1A.

Referring now to the drawings, there is shown a sonde housing assembly 10. FIGS. 1A and 1B are complimentary to one another; the housing assembly 10 is illustrated in two parts so that a larger drawing scale is obtained but it will be understood that the actual housing assembly is a single integrated assembly. The housing assembly 10 comprises a main shell body 11 having end pieces or tool joints 12, 13 at each end. The shell body 11 is preferably formed as a length of suitable round steel tubing which may be a high alloy hardened steel material for improved strength. The end pieces 12, 13 are also fabricated of a suitable steel and are in the form of hollow heavy wall sleeves having through bores 16, 17. In the illustrated case, the end piece or tool joint 12 on the right has an internal thread form designated by the American Petroleum Institute as an API IF thread which is commonly used in drill pipe. The end piece or tool joint 13 at the left is an internal thread designated by the American Petroleum Institute as an API REG thread which is used to couple with the drill head of horizontal directional drilling apparatus known in the art.

An extension 21 on an inward end of each of the end pieces 12, 13 is telescoped into a bore 22 of the shell body 11 to facilitate alignment and assembly of these parts. Axially and radially outward of the extension 21, each end piece 12, 13 is chamfered to permit a circumferentially continuous fluid-tight weld bead 23 to be formed between the end piece and the shell body 11 to thereby join these parts together. The shell body 11 has a plurality of apertures in the form of axially extending slots 26 cut through its wall 27 to permit external transmission of radio waves from a transmitter carried in the housing assembly 10 as discussed below.

Figure 2:
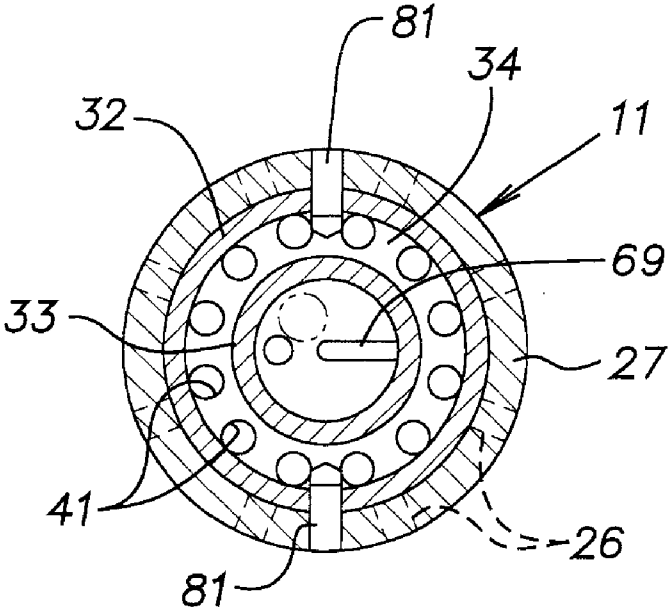
FIG. 2 is a cross-sectional view of the sonde housing taken in a plane transverse to the longitudinal axis of the housing as indicated by the arrows 2—2 in FIG. 1A.

Positioned in the shell body 11 before one or both of the end pieces 12, 13 are welded on is a cartridge assembly 31. The cartridge assembly 31 includes an outer sleeve 32 and an inner tube 33 within the sleeve. The sleeve 32 and tube 33 are held in concentric relation by a pair of annular adapters 34 and a ring 36. Preferably, the adapters 34 are identical units having the general form of a short tube or ring with an internal cylindrical surface or bore 37 and a cylindrical outer surface 38. As shown in FIG. 2, a wall 39 of the adapter 34 is drilled or otherwise formed with a plurality of axial bores or passages 41 angularly spaced about its circumference. At an inner end, the adapter 34 has a counter bore 42 for receiving a short portion of the length of the inner tube 33. Similarly, the inner end of each adapter 34 has a reduced diameter outer surface 43 that fits into the inside diameter of the sleeve 32. When the ends of the sleeve 32 and the tube 33 are respectively assembled in and on the adapter 34, these parts are held concentric with one another. The ring 36 is similar in cross-section to the adapters 34, but shorter in length, and is disposed around the tube 33 and in the sleeve 32. The ring 36 is adhesively attached or otherwise fixed at the mid-lengths of the tube 33 and sleeve 32. The ring 36 includes circumferentially spaced axial passages 46 to permit fluid passage through an annulus 35 between the tube 33 and sleeve 32. In the illustrated example, the tube 33 and sleeve 32 are made of rigid polyvinylchloride such as the type conventionally used for plastic pipe. The surfaces of contact between the adapters 34 and ring 36 with the tube 33 and with the sleeve 32 are joined together with a suitable adhesive. Outer ends of the tubular adapters 34 have internal threads 47. A retainer 51 at one end of the cartridge assembly 31 (FIG. 1A) has external threads complimentary to the adapter threads 47. The retainer 51 has an outer portion 53 with a hexagonal or other acircular cross-section in end view enabling it to be tightened or untightened in the adapter threads 47. A radial shoulder 54 of the retainer 51 is proportioned to abut an end face 56 of the adapter 34 when the retainer is fully threaded into the adapter. The contact between the shoulder 54 and end face 56 prevents the retainer 51 from being over-tightened. The retainer 51 has a central axial bore 57 in which is received an indexer 58. The indexer 58 has a cylindrical central portion 59 sized to rotate in the retainer bore 57. The indexer 58 is captured on the retainer 51 with a metal snap ring 61 at one end and a radially extending flange 62 at the other end. An elastomeric O-ring 63 disposed in a peripheral groove on the central cylindrical portion 59 of the retainer seals with the bore 57. An elastomeric O-ring 64 located in a groove in the flange 62 seals against a radial inner face of the retainer 51. At an outer end 66, the indexer 58 has a hexagonal profile, in end view, to permit the indexer to be selectively rotated with a wrench. On an inner radial face, the indexer 58 has an integral key 69 that enables it to be rotationally interlocked with a radio transmitter 67 disposed in a chamber 68 circumferentially bounded by the inner surface of the tube 33. The transmitter 67 is manually rotated or "clocked" in the chamber 68, as is known in the art, by rotating the indexer 58.

On an opposite end of the cartridge 31 (FIG. 1B), a plug 71 with male threads complimentary to the adapter threads 47 is removably threaded into the adapter 34. The plug 71 has a peripheral groove that receives an elastomeric O-ring 73 which seals with the adapter counterbore 42. An outward portion 74 of the plug 71 has a hexagonal shape when viewed axially to permit the plug to be tightened or untightened into the threads 47 of the adapter. A radial shoulder 76 on the plug 71 abuts the end face 56 of the adapter 34 to prevent the plug from being inadvertently over-tightened.

The transmitter 67 and a battery 78, both known in the art, can be disposed in the chamber 68. A compression spring 79 holds the transmitter 67 and battery 78 in place with the transmitter coupled with the key 69 on the indexer 58. The transmitter 67 and battery 98 can be assembled and removed from the chamber 68 through the end piece 12 by installing or removing the plug 71 with a wrench.

The cartridge assembly 31 comprising the outer sleeve 32, inner tube 33, adapters 34, retainer 51 and plug 71 is inserted in the shell body 11 before at least a last one of the two end pieces 12 or 13 is welded or otherwise joined to the shell body. The cartridge assembly 31 is fixed relative to the shell body 11 by tightly fitting spring pins 81 extending through holes drilled through the shell wall 27 and into the walls of the adapters 34. The outer periphery of the adapters 34 is machined or otherwise formed with a pair of spaced circumferential grooves in which are received elastomeric O-rings 82. The O-rings 82 provide a fluidtight seal between the cartridge assembly 31 and interior surface of the bore 22 of the shell body 11.

In use, fluid typically primarily recycled water is received by the end piece 12 (FIG. 1B) from a drill pipe string to which the end piece or tool joint is coupled by threading it onto the same. The fluid diverges over the plug 71 and passes through the several peripheral openings or passages 41 in the associated adapter 34. This fluid then passes through the annulus 35 between the inner tube 33 and outer sleeve 32, the passages 46 in the ring 36 and through the openings or bores 41 in the other adapter 34 and ultimately passing out of the end piece 13. It will be understood that substantially the full circumference of the tube 33 and, therefore, the transmitter 67 is surrounded by this fluid so that full cooling of the transmitter is obtained.

The fluid pumped through the sonde housing assembly 10, despite filtering, can become abrasive by picking up fine sand or other particulate material from the geological formation through which it is recycled. In this circumstance, the surfaces of the cartridge assembly 31 can become worn away with extended use even though it has been found that plastic material such as polyvinylchloride is remarkably durable when compared with the typical steels used in similar applications. The cartridge assembly 31 can be replaced by cutting off one of the end pieces 12 or 13 from the shell body 11 at the weld bead 23, removing the worn cartridge assembly and replacing it with a new one. Thereafter, the end piece can be rewelded onto the shell. It will be understood that the inner tube 33 and outer sleeve 32, being formed of a non-metallic material such as polyvinylchloride or other material of suitable structural strength and transparent to radio waves, eliminate the need for separately sealing the apertures or slots 26 in the wall 27 of the shell body 11.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cartridge for use in a sonde housing comprising a pair of tubular members each having longitudinally spaced ends, one of the tubular members surrounding a portion of the other tubular member, the tubular members being axially fixed relative to one another and providing a passage therebetween for drilling/cooling fluid, the other tubular member having an interior chamber for receiving a transmitter, structure sealing the ends of the other member to enclose the chamber, said structure being openable to place or remove the transmitter into or from the chamber, the members each being of a material that readily permits passage of radio signals.

2. A sonde housing comprising a hollow steel shell body having a relatively thin wall and longitudinally spaced ends, a tool joint at each end of the shell body, the wall of the shell body having circumferentially spaced apertures extending radially through the wall, a tubular body disposed within the shell body and having longitudinally spaced ends, the tubular body being formed of a rigid material permeable by radio waves, fluidtight closures at each end of the tubular body, the tubular body and closures forming a fluidtight chamber, one of said closures being openable to insert or remove a radio transmitter to or from the chamber, a passage for conducting drilling/cooling fluid from one tool end to the other while reducing transfer of heat from the shell body generated during drilling operations to the transmitter, and a circumferentially continuous sleeve of a rigid material transparent to radio wave signals from the transmitter forming a lining in the shell body to prevent flow of fluid through the apertures in the wall of the shell body.

3. A sonde housing comprising a cylindrical steel shell body having tool joints at each end for coupling with a drill pipe at one end and a drill head at the other end, the shell body having a relatively thin cylindrical wall compared to its length, the wall having through apertures at locations spaced about its circumference, a cartridge assembly disposed in the shell body between the tool joints, the cartridge assembly including concentric tubes, an inner one of said tubes being closed at its ends to form a sealed chamber, at least one of the inner tube ends being openable and reclosable to place or remove a radio transmitter in or from the chamber, the inner and an outer tube each being constructed of material that is transparent to radio signals, support members adjacent the ends of the inner tube to maintain the outer tube concentric with the inner tube, such that the inner and outer tubes form an annular passage area, the outer tube being sealed with an inside surface of the shell body at axially spaced locations that are upstream and downstream of the apertures with reference to flow of fluid through the passage area, while allowing drilling/cooling fluid to pass through the annular passage area.

4. A sonde housing as set forth in claim 3, wherein said support structure is formed by an annular ring with axial circumferentially spaced holes extending therethrough.

5. A sonde housing as set forth in claim 3, wherein the outer tube and inner surface of the shell body are sealed with elastomeric O-rings at locations upstream and downstream of said apertures.

6. A sonde housing as set forth in claim 5, wherein said O-rings are provided in pairs at said locations.

7. A sonde housing as set forth in claim 5, wherein said O-rings are received in grooves formed in said outer tube.

8. A sonde housing as set forth in claim 3, wherein said apertures are axially aligned slots.

9. A sonde housing as set forth in claim 3, wherein said inner tube is formed of polyvinylchloride.

10. A sonde housing as set forth in claim 3, wherein said outer tube is formed of polyvinylchloride.

11. A sonde housing as set forth in claim 3 wherein said tool joints are sleeve elements welded onto said shell body with circumferentially continuous weld beads.

12. A sonde housing as set forth in claim 3, wherein the cartridge assembly has an adapter adjacent an end of the inner tube, the adapter being internally threaded, and a closure body threaded into said threads of the adapter, the closure body having a radially extending shoulder arranged to abut a radial face on the adapter to limit the threaded engagement of the closure into the adapter.

* * * * *